US005659904A

United States Patent [19]

Doczy et al.

[11] Patent Number: 5,659,904

[45] Date of Patent: Aug. 26, 1997

[54] TUB GRAB BAR

[75] Inventors: Paul J. Doczy, Chicago; Craig Scherer, Wilmette; Keith D. Alsberg, Chicago; Michael C. Thuma, Desplaines; John Steck, Schaumburg; Brian J. Woodard; Jeff R. Condon, both of Chicago, all of Ill.

[73] Assignee: BRK Brands, Inc., Aurora, Ill.

[21] Appl. No.: 691,216

[22] Filed: Aug. 1, 1996

[51] Int. Cl.[6] ..... A47K 3/12

[52] U.S. Cl. ..... 4/577.1; 4/576.1; 248/231.41; 248/228.3; 294/16; 294/103.1; 74/557; 74/528.1; 74/543; 74/545; 74/523

[58] Field of Search ..... 4/559, 571.1, 574.1, 4/576.1, 577.1, 575.1, 572.1, 578.1, 579, 604, 570, 573.1, 567, 615, 413, 414; 248/231.41, 228.3; 294/16, 103.1; 269/244, 249; 81/487; 74/557, 528, 543, 545, 523

[56] References Cited

U.S. PATENT DOCUMENTS

| | | |
|---|---|---|
| D. 113,014 | 12/1939 | Grimm . |
| D. 173,415 | 11/1954 | DuBrie . |
| D. 188,175 | 6/1960 | Craig . |
| D. 189,906 | 3/1961 | Best . |
| D. 209,040 | 10/1967 | Aleka . |
| D. 211,877 | 8/1968 | Doman . |
| D. 233,756 | 11/1974 | Schrock . |
| D. 282,963 | 3/1986 | Alger . |
| D. 286,068 | 10/1986 | Landsberger . |
| D. 305,401 | 1/1990 | Winston . |
| D. 316,139 | 4/1991 | DiVito et al. . |
| 1,311,635 | 7/1919 | Baker . |
| 1,704,639 | 3/1929 | Thompson . |
| 1,775,301 | 9/1930 | Wiebmer . |
| 2,005,576 | 9/1935 | Buhl et al. . |
| 2,034,705 | 3/1936 | Anderson et al. . |
| 2,045,815 | 6/1936 | Wiesjahn . |
| 2,058,188 | 10/1936 | Stanton . |
| 2,328,235 | 8/1943 | Setzier . |
| 2,430,027 | 11/1947 | Morrison . |
| 2,511,756 | 6/1950 | Wallace . |
| 2,642,581 | 6/1953 | Loe . |
| 2,644,954 | 7/1953 | Jumper . |
| 2,756,439 | 7/1956 | Bollen . |
| 2,807,029 | 9/1957 | Armstrong . |
| 2,817,095 | 12/1957 | Jeffries . |
| 2,836,834 | 6/1958 | Tisdall . |
| 2,885,690 | 5/1959 | Scott . |
| 2,924,374 | 2/1960 | Vinsberg . |
| 2,931,051 | 4/1960 | Sparling . |
| 2,940,085 | 6/1960 | Hussey . |
| 3,098,240 | 7/1963 | Fleenor . |
| 3,156,977 | 11/1964 | Logan . |

(List continued on next page.)

FOREIGN PATENT DOCUMENTS

| | | |
|---|---|---|
| 810914 | 2/1957 | South Africa . |

*Primary Examiner*—Henry J. Recla
*Assistant Examiner*—Charles R. Eloshway
*Attorney, Agent, or Firm*—Dressler, Rockey, Milnamow & Katz

[57] ABSTRACT

A tub grab bar adapted to be removably mounted to a bath tub includes a main body portion having at least one grasping region oriented generally perpendicular to the tub wall. The bar has first and second clamping members adjustably positionable relative to one another in a direction generally parallel to the at least one grasping region. The clamping members are adapted to secure the grab bar to the bath tub wall. The bar farther includes first and second tub gripping elements. The gripping elements are mounted to a respective one of the clamping members. At least one of the gripping elements is multi-accurately, pivotally mounted to its respective clamping member to permit the gripping element to fully engage the bath tub wall when the clamping members are secured to the bath tub wall. The main body portion of the grab bar includes a pair of generally parallel, spaced apart stabilizing elements positioned with at least one of the clamping members therebetween. The stabilizing elements maintain the grab bar in an upright position on the bath tub wall prior to and during securement thereto.

3 Claims, 4 Drawing Sheets

U.S. PATENT DOCUMENTS 3,414,909 12/1968 Provi et al. .
3,414,910 12/1968 Provi et al. .
3,422,466 1/1969 Banoczi .
3,448,468 6/1969 Mureon .
3,555,576 1/1971 Coakley .
3,568,220 3/1971 Decs .
3,604,019 9/1971 Garner .
3,713,179 1/1973 Dubiel .
3,894,300 7/1975 Shively .
3,968,524 7/1976 Zentman .
3,971,080 7/1976 Walker .
3,996,631 12/1976 Fields .
4,034,425 7/1977 Van Riemsdyck .
4,149,282 4/1979 Browning .
4,162,544 7/1979 Freeman .
4,228,552 10/1980 Weaver .
4,319,687 3/1982 Hull .
4,417,361 11/1983 Smith .
4,549,763 10/1985 Wilkerson .
4,706,311 11/1987 Jarosinski .
4,887,323 12/1989 DiVito et al. .
4,908,906 3/1990 Hanna .
4,987,619 1/1991 Smith .
5,050,252 9/1991 Cuttriss .
5,101,521 4/1992 Levien .
5,105,483 4/1992 Levien .
5,249,315 10/1993 Moylan .
5,324,085 6/1994 Hinz .

FIG. 4
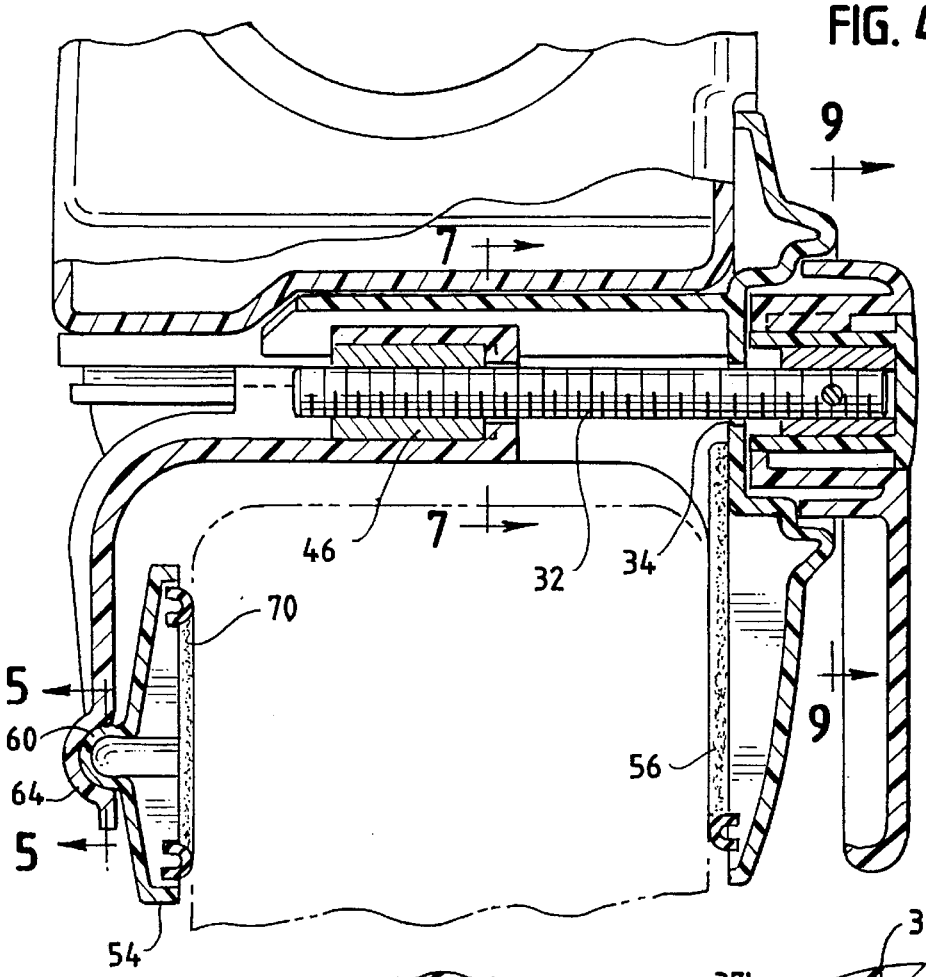
FIG. 8
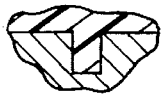
FIG. 5
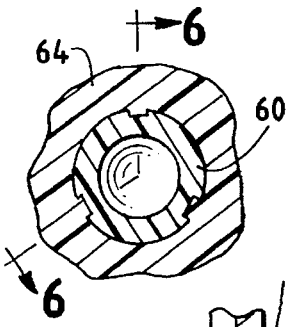
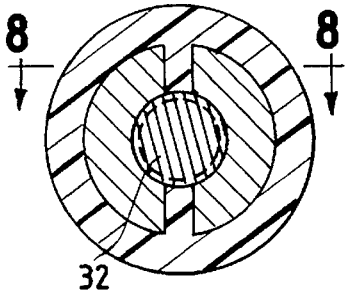
FIG. 7
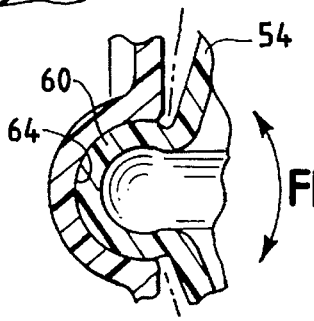
FIG. 6
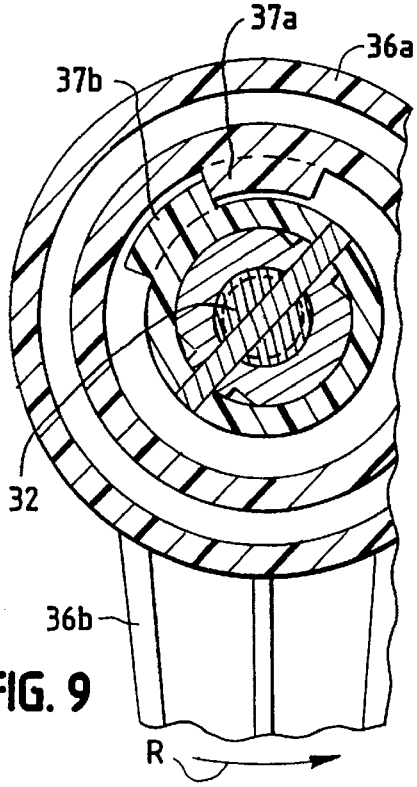
FIG. 9

TUB GRAB BAR

FIELD OF THE INVENTION

This invention relates to a grab bar for a bath tub. More particularly, the invention relates to a portable tub grab bar which is readily installed and removed from a bath tub as needed.

BACKGROUND OF THE INVENTION

Bath tub grab bars are known in the art. They are commonly used by elderly persons, injured or infirm persons, to assist in getting into and out of a bath tub. Because bath tubs are known to become slippery when wet, such grab bars may also be used by others to help maintain balance while in the bath tub.

Tub grab bars may also be used by persons who are bathing, to assist in placing one's self into a sitting position in the tub, and to assist in getting up from the tub after the bath. As such, grab bars must be substantially self supporting, and must have sufficient strength to support a person's full weight from various angles.

One known type of bath tub grab bar includes a pair of tub gripping portions which are connected by a main body portion. The main body portion includes an upwardly extending handle. The main body also includes a threaded rod and a complementary threaded hollow member for clamping the grab bar to the bath tub. The grab bar includes a single balancing element which extends generally transverse relative to the handle, to provide balance for the grab bar. The balancing element is outside of the grab bar body.

Another known grab bar includes an upwardly extending handle and a clamping mechanism. The grab bar is supported by a single, angle-like member which is mounted to the grab bar at about the clamp. The single support which is external of the grab bar body, serves to balance the grab bar when in use.

Notwithstanding known tub grab bars, there continues to be a need for a tub grab bar which includes at least one upwardly extending handle, and which further includes at least two, spaced apart stabilizing elements for stabilizing the grab bar prior to and after the grab bar has been secured to the bath tub wall. Preferably, the stabilizing elements are formed as part of, and internal to, the grab bar body. In a preferred configuration, such a grab bar is readily installed and removed from the bath tub wall by a single clamping operation.

SUMMARY OF THE INVENTION

A tub grab bar which is adapted to be removably mounted to a bath tub wall includes a main body portion having at least one grasping region oriented generally perpendicular to the tub wall. The grab bar includes first and second clamping members which are adjustably positionable relative to one another in a direction generally parallel to the at least one grasping region.

The clamping members are adapted to secure the grab bar to the bath tub wall. The grab bar includes first and second tub gripping elements. Each gripping element is mounted to a respective one of the first and second clamping members.

At least one of the gripping elements is pivotally mounted to its respective clamping member. This structure permits the gripping element to fully engage the bath tub wall when the clamping members are secured to the bath tub wall.

The main body portion further includes a pair of generally parallel, spaced apart stabilizing elements positioned with at least one of the first and second clamping members therebetween. The stabilizing elements maintain the grab bar in an upright position on the bath tub wall prior to and during securement thereto.

In a preferred embodiment, the grab bar includes a stationary clamping member and a movable clamping member. The pivotally mounted gripping element is mounted to the movable clamping member. The multi-accurately, pivotable gripping element permits the grab bar to be used on bath tubs having non-parallel inner and outer tub walls.

Other features and advantages of the present invention will be apparent from the following derailed description, the accompanying drawings, and the appended claims.

BRIEF DESCRIPTION OF THE FIGURES

FIG. 4 is a partial cross-sectional view of the tub grab bar illustrating the clamping mechanism;

FIG. 5 is a cross-sectional view of the clamp to pad connection viewed across line 5—5 of FIG. 4;

FIG. 6 is a cross-sectional view of the clamp to pad connection taken along line 6—6 of FIG. 5;

FIG. 7 is a cross-sectional view of the clamping mechanism taken along line 7—7 of FIG. 4;

FIG. 8 is a cross-sectional view of the clamping mechanism taken along line 8—8 of FIG. 7; and FIG. 9 is a cross-sectional view of the clamping mechanism and clamp handle taken along line 9—9 of FIG. 4.

DETAILED DESCRIPTION OF THE PREFERRED EMBODIMENTS

Figure 1:
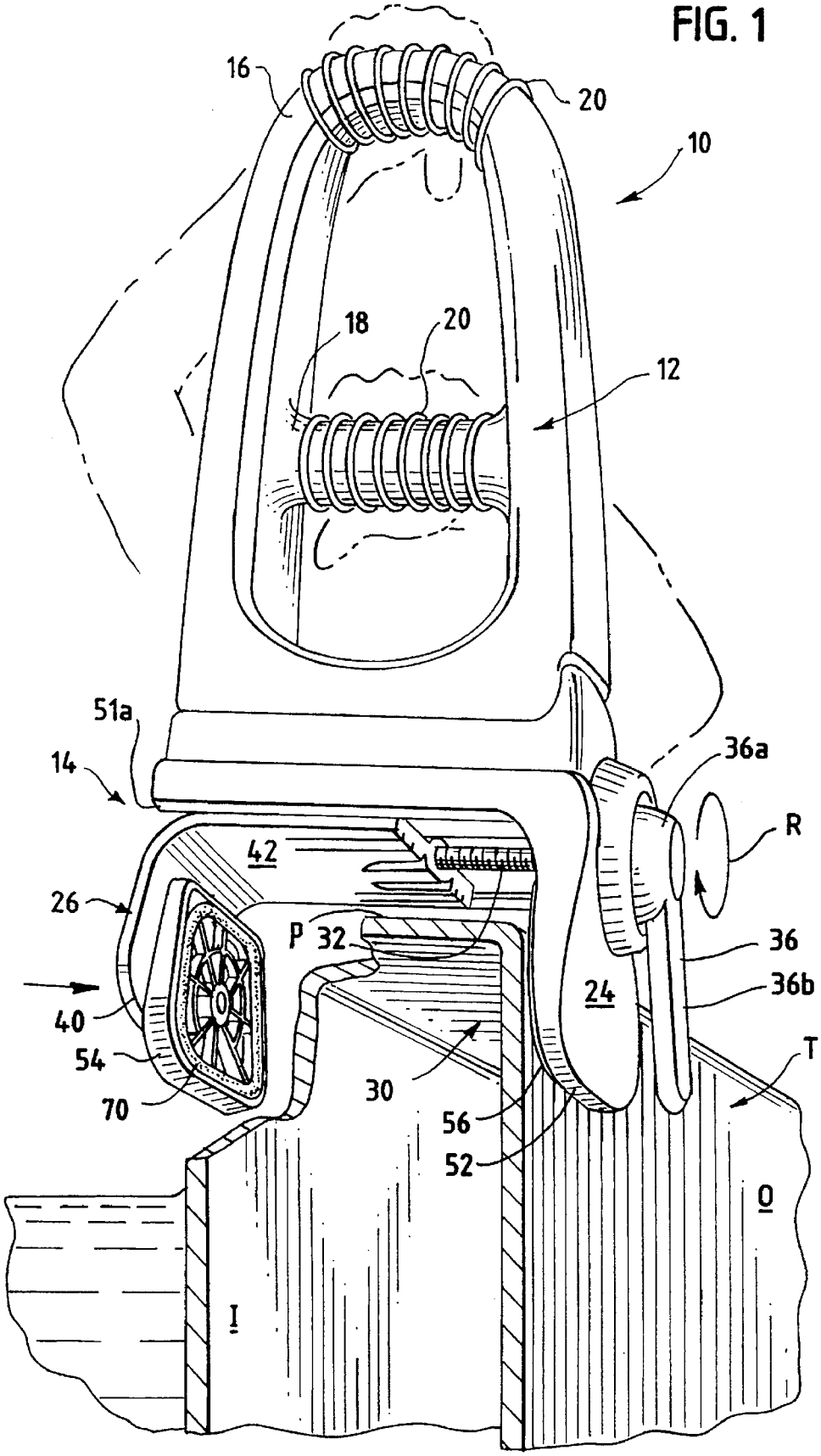
FIG. 1 is a perspective view of a tub grab bar embodying the principles of the present invention, illustrated with a bath tub shown in partial cross-section.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Figure 2:
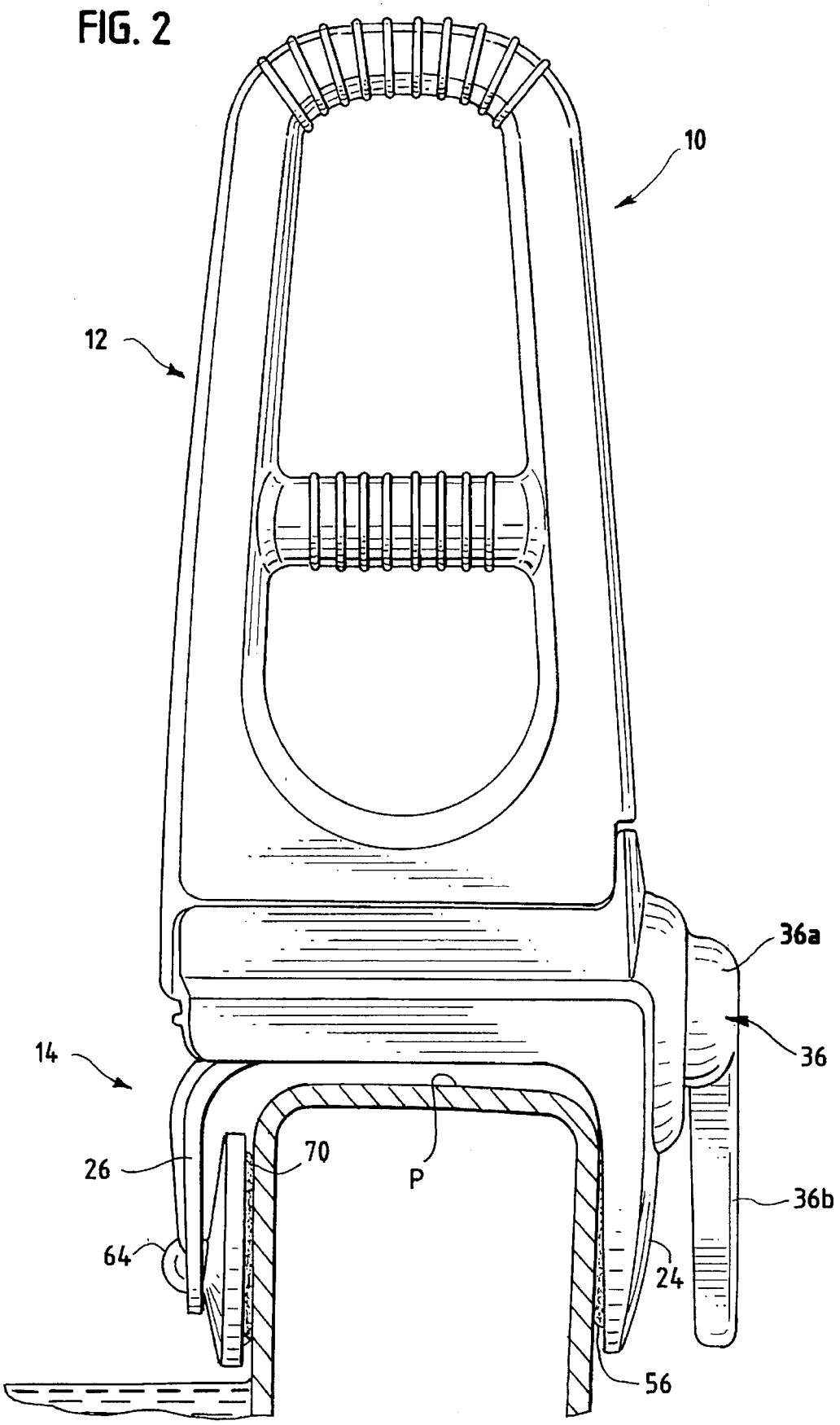
FIG. 2 is a side view of the tub grab bar of FIG. 1, illustrated mounted to a bath tub,. with the tub shown in partial cross-section.
Figure 3:
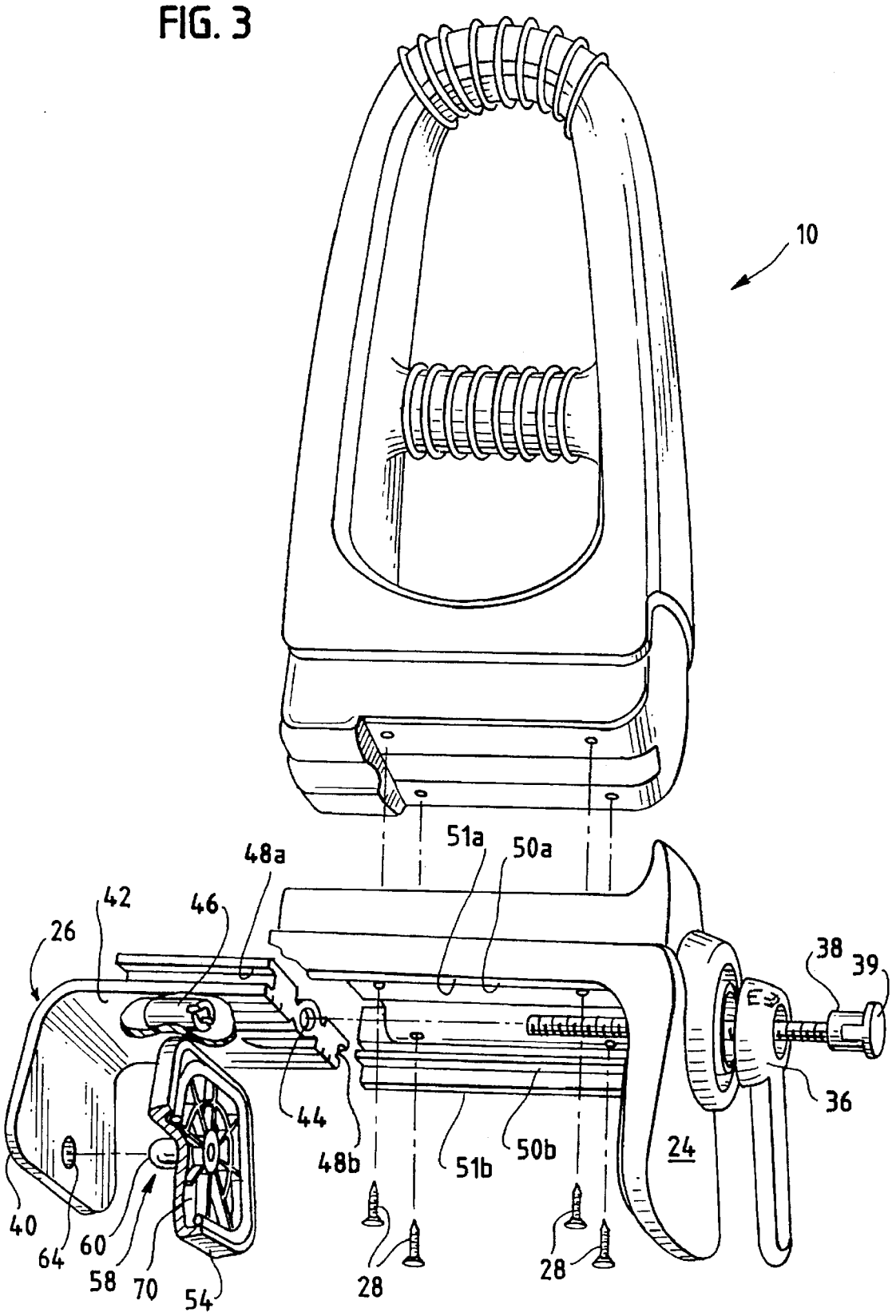
FIG. 3 is an exploded perspective view of the tub grab bar of FIG. 1.

With reference now to the figures, and particularly to FIGS. 1 and 2, a tub grab bar 10 embodying the principles of the present invention is illustrated. The grab bar 10 is illustrated with a bath tub T for perspective, and is shown with a user's hands grasping the grab bar 10.

The grab bar 10 includes, a main body portion 12 and a clamping portion 14. The body 12 includes at least one grasping region or handle, such as the exemplary upper and lower handles 16, 18 of the grab bar 10. In the illustrated embodiment, the handles 16, 18 are oriented generally perpendicular to the inner and outer walls of the tub.

Preferably, the handles 16, 18 include a plurality of raised ribs 20 or a roughened region to facilitate grasping the handles 16, 18 and to prevent the user's hands from slipping from the handles 16, 18.

The clamping portion 14 includes first and second clamping members 24, 26 which are adjustably positionable toward and away from each other. In the illustrated embodiment, the clamping members 24, 26 are positionable in a direction generally parallel to the handles 16, 18.

In a preferred configuration, one of the clamping members 24 is stationary, and may be formed as part of the main body 12, or may be mounted thereto. The other clamping member 26 is movable toward and away from the stationary member 24. The clamping members 24, 26 have a generally L-shaped configuration. The stationary clamping member 24 may be mounted to the main body portion 12 by fasteners, such as the exemplary screws 28.

Movement of the movable clamping member 26 relative to the stationary member 24 is effected by a clamping mechanism 30. Referring to FIGS. 3–8, the clamping mechanism 30 includes a threaded rod or shaft 32 which extends through an opening 34 in the stationary member 24.

The shaft 32 has a handle 36 mounted thereto, such as by a key-way type fastener 38. The key-way fastener is fastened to the shaft by a bolt 39. The key-way fastener 38 translates rotation of the handle 36 into rotation of the shaft 32.

The movable clamping member 26 has a clamping leg 40 and a positioning leg 42. The positioning leg 42 has an opening 44 therein which is adapted to receive the shaft 32.

An internally threaded insert 46 is positioned within the movable clamping member 26, adjacent to and coaxial with, the opening 44. The insert 46 is configured to receive the threaded shaft 32, and to translate rotational movement of the shaft 32 to linear movement of the movable clamping member 26 relative to the stationary clamping member 24, i.e., movement of the movable member 26 toward and away from the stationary member 24.

Thus, when the handle 36 is mined, the shaft 32 rotates, which in turn moves the movable clamping member 26 toward or away from the stationary member 24, dependent upon whether the handle 36 is rotated clockwise or counter-clockwise.

The movable clamping member 26 includes a pair of guide channels 48*a,b* formed in the sides thereof. Each channel 48*a,b* is adapted to be received by a respective guide projection 50*a,b* formed in the grab bar 10, at about the stationary clamping member 24. In the illustrated embodiment, the projections 50*a,b* are formed in the stationary clamping member 24.

The channels 48*a,b* and projections 50*a,b* facilitate linear movement of the movable member 26 relative to the stationary member 24, and prevent transverse movement or slippage of the movable member 26.

The stationary clamping member 24 includes a pair of elongated, spaced apart stabilizing surfaces 51*a,b*. The stabilizing surfaces 51*a,b* are oriented generally parallel to the guide projections 50*a,b*, and are adapted to rest on the tub top wall P when the grab bar 10 is positioned on the tub T as illustrated in FIG. 2. The stabilizing elements 51*a,b* are configured so that at least the movable clamping member 26 is positioned between the surfaces 51*a,b*.

The stabilizing surfaces 51*a,b* maintain the grab bar 10 in place when the bar 10 is positioned on the tub T, before and after it is secured thereto. Essentially, the spaced apart stabilizing surfaces 51*a,b* provide additional stability and balance to the grab bar 10 when in use.

The clamping members 24, 26 each include a respective tub gripping element 52, 54. One of the tub gripping elements, preferably the element 52 positioned on the stationary clamping member 24 is substantially planar and fixedly mounted to the damping member 24. The griping element 52 may include, for example, a non-slip material, such as a closed cell foam pad or strip 56, affixed thereto, to enhance securement to the bath tub outer wall.

The other tub griping element 54 is pivotable. The element 54 is pivotally connected to the clamping leg 40. This arrangement permits the grab bar 10 to be securely mounted to a bath tub T that has an inner wall I and an outer wall 0 which may not be parallel.

To effect the pivoting, the gripping element 54 includes a ball and socket-like connecting joint 58. The gripping element 54 includes a ball-like projection 60 extending from a rear surface thereof. The damping leg 40 includes a socket 64. The element 54 can thus rotate slightly to take into account non-parallel inner and outer walls I, 0.

The gripping element 54 may include a non-slip material, such as a closed cell foam pad or strip 70, affixed thereto, to enhance securement to the bath tub walls.

The grab bar 10 is prepared for use by rotating the handle 36 counter-clockwise in a direction opposite to R until the gripping elements 52, 54 are set a distance apart greater than the thickness of the bath tub walls. The grab bar 10 is then positioned on the tub with the handle 36 outward of the tub T, and with both stabilizing elements 51*a,b* resting on the tub top wall P. The handle 36 is then rotated clockwise in a direction R until the gripping elements 52, 54 secure the bar 10 to the tub.

The grab bar 10 is readily removed from the tub T by rotating the handle 36 counter-clockwise.

One of the advantages of the grab bar 10 is the structure and operation of the handle 36. The handle 36 includes a hub 36*a* to which is coupled a rigid extension member 36*b*.

When a user goes to mount the tub grab bar 10 on the tub T, the handle 36 is rotated in the direction R thereby clamping the grab bar 10 to the tub. During this process the extension member 36*b* provides a rigid elongated member to which a user can apply a clamping force which in turn translates into a torque which rotates the shaft 32. The hub 36*a* is rigidly attached to the extension member 36*b* and there is no relative motion therebetween.

The hub 36*a*, best illustrated in FIG. 9, is mounted for movement both in the direction R and opposite the direction R. When the grab bar 10 is clamped to a tub T, the extension member 36*b* can be rotated in a direction opposite that of the clamping direction R without releasing the bar 10 from the tub tee. This rotation exceeds more than 180 degrees as illustrated in FIG. 9.

This ability to back-off the extension member 36*b* is provided by cam members 37*a*, carried on the hub 36*a* and 37*b* which is rigidly coupled to the shaft 32. Thus, as illustrated in FIG. 9, rotation of the extension member 36*b* in the direction R causes the cam members 37*a* and 37*b* to engage one another thereby causing the bolt 32 to rotate increasing clamping force applied by the bar 10 to the tub T. Rotating the extension member 36*b* in the direction opposite R causes disengagement of the cam members 37*a*, 37*b* such that the extension member 36*b* can be rotated almost 270 degrees before the cam member 37*a* again engages the cam member 37*b*. This makes it possible to position the extension member 36*b* out of way notwithstanding the fact that it is rigidly coupled to the hub 36*a*.

The process of releasing the bar 10 involves moving the extension member 36*b* in the direction opposite R such that the cam members 37*a* and 37*b* again engage one another thereupon rotating the bolt 32 and releasing the clamping members from the tub T.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A removably mountable bathtub grab bar comprising:

a grab bar adapted to extend transversely of a bathtub side wall when mounted thereabove;

a releasable clamping element coupled to said grab bar and adapted to clamp onto said bathtub side wall;

means for releasably clamping said clamping element;

an elongated rotatable handle, said handle having an elongated extension rigidly coupled thereto for contacting and moving said means for releasably clamping, rotation of said handle in a first direction and in a second, opposite direction causing said elongated extension to move in an arc of predetermined length before contacting and moving said means for releasably clamping to clamp said grab bar to, and release said grab bar from, said bathtub side wall.

2. A grab bar as in claim 1 wherein the predetermined arc exceeds 180 degrees.

3. A grab bar as in claim 1 wherein the clamping element includes a generally U-shaped member with first and second substantially parallel sides wherein one of the sides moves toward the other in response to rotation of the handle in the first direction.

* * * * *